United States Patent [19]

McEachern

[11] Patent Number: 4,852,490

[45] Date of Patent: Aug. 1, 1989

[54] MAGNETIC CYLINDER HAVING RIGID SUPPORT FOR MAGNET COVER

[75] Inventor: David A. McEachern, St. Paul, Minn.

[73] Assignee: T. D. Wright, Inc., St. Paul, Minn.

[21] Appl. No.: 211,829

[22] Filed: Jun. 27, 1988

[51] Int. Cl.[4] ..... B41F 27/02; B41F 27/06

[52] U.S. Cl. ..... 101/378; 118/DIG. 15; 101/389.1

[58] Field of Search ..... 101/382 MV, 378, 389.1; 335/295; 118/DIG. 15

[56] References Cited

U.S. PATENT DOCUMENTS 3,721,189 3/1973 Bray ..... 101/382 MV
3,742,852 7/1973 Leefler et al. ..... 101/382 MV
4,676,161 6/1987 Peekna ..... 101/382 MV

FOREIGN PATENT DOCUMENTS 1381468 1/1975 United Kingdom ..... 101/382 MV

*Primary Examiner*—Edgar S. Burr
*Assistant Examiner*—Tonya Lamb
*Attorney, Agent, or Firm*—Jacobson and Johnson

[57] ABSTRACT

A magnetic cylinder for use in printing or die cutting has annular spaced-apart pole pieces with flexible or pliable annular magnets in the spaces between the pole pieces, a protective covering over the magnets and supports alongside the magnets for structurally supporting the protective covering.

9 Claims, 1 Drawing Sheet

MAGNETIC CYLINDER HAVING RIGID SUPPORT FOR MAGNET COVER

FIELD OF THE INVENTION

The invention is in the field of a curved surface magnetic latch or holding device in the form of a magnetic cylinder or a section of a magnetic cylinder which is used for holding printing plates and rotary dies and which is made using somewhat flexible or pliable magnets.

DESCRIPTION OF THE PRIOR ART

The prior art is best exemplified by U.S. Pat. Nos. 3,810,055 to Wright and 4,676,161 to Peekna. These prior art devices have a central core, radially extending annular spaced-apart pole pieces, radially extending annular magnets made of a relatively pliable or flexible material in the spaces between the pole pieces and a protective covering over the outside of the magnets. It has been found in some applications that when a printing plate is placed on the magnetic cylinder and put into operation, the forces experienced are such that the magnets and the covering layer are unable to support the printing plate so that the covering layer and magnet as well as the plate in the area over the magnet tend to buckle or collapse. The same has been found to occur in using these types of magnetic cylinders where high surface pressure occurs in rotary die cutting using flexible steel dyes which are magnetically held by the magnetic cylinder.

SUMMARY OF THE INVENTION

The instant invention provides additional structural support for the covering layer over the magnet of a magnetic cylinder of the nature described hereinabove to prevent it and the magnet from collapsing or buckling due to forces and pressures applied against the outside of the cylinder in some printing and die cutting operations. The support is a rigid member which extends radially outward from the cylinder core alongside the magnet to the underside of the covering layer. The support may be provided along only one side of each magnet or along both sides of each magnet. Preferably the support is made from a material having a magnetic permeability at least as great as the pole pieces or, alternatively, the pole pieces themselves can be made with a ledge to provide the support for the covering layer. The supports not only provide additional structural strength but may also provide a greater permeable mass for the magnets to energize which would allow the use of more powerful magnets than had been possible previously. In addition the supports allow the covering layer to be made quite thin thereby bringing the magnet closer to the drum surface so that the drum or cylinder should have greater magnetic holding strength.

DESCRIPTION OF THE PREFERRED EMBODIMENTS

Figure 1:
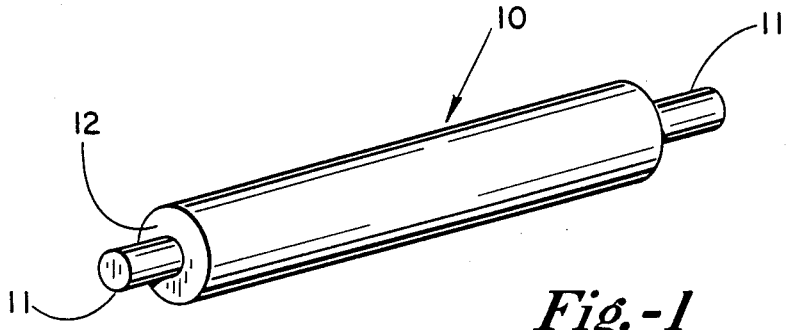
FIG. 1 is a perspective view of a magnetic cylinder constructed according to the teachings of this invention.

A magnetic cylinder 10 includes a drive shaft 11 surrounded by or being part of a core 12 and having annular pole pieces and magnets. The core 12 may be made up of separate sections, for example an inner solid member 12A (FIG. 2) surrounded by a sleeve 12B and may even be partially hollowed out. For our purposes, however, the core can be considered to be a single rigid member which may or may not include shaft 11. As described in some detail in the aforementioned patents, the cylinder has axially spaced-apart annular pole pieces 13 extending radially out from the core. In the spaces between the pole pieces are annular magnets 15 which are covered with annular covering layers 16. The pole pieces are made out of some suitable ferro-magnetic material. Typically the magnets are strips of somewhat flexible or pliable permanent magnets. One type, for example, is a rubber bonded barium ferrite composite material which is known and available commercially under the registered trademark name "Plastiform" made by Minnesota Mining and Manufacturing Company. Other types of magnets may be made of rare earth materials. Also, some magnets may be made of molded plastic. While these are not as flexible or pliable as the aforementioned strips, they also lack the structural strength to withstand the excessive forces which may occur in use. The magnets are arranged to form alternate poles at successive pole pieces so as to provide the magnetic paths to hold a plate or die 17 tightly to the outside of the cylinder. The covering layer 16 is made of some suitable stiff non-magnetic or non-permeable material to protect the magnets.

As mentioned earlier, in the areas on the outside of the cylinder above the magnets 15 and covering layers 16, in certain instances pressures applied radially by the die or plate can cause the die or plate 17 as well as the covering layer and magnets to buckle or collapse inward. To offset this, the present invention provides rigid supports 20 extending radially outward from the core 12 alongside the magnets 15 to the underside of covering layers 16. Preferably these are annular supports or shims which may be made of the same material as the pole pieces. Alternatively, supports 20 can be made of some suitable structurally sound material which has a magnetic permeabllity as great as, or greater than, the pole piece material. This provides a larger magnetically permeable mass for the magnet to energize which may permit the use of magnets more powerful than were useable previously. Also, as a result of the additional structural support the covering layer 16 can be made thinner than in the past with the result that the points of maximum magnetic field strength of the magnets can be brought closer to the outer surface of the cylinder thereby providing greater magnetic holding strength for the die or printing plate.

Figure 2:
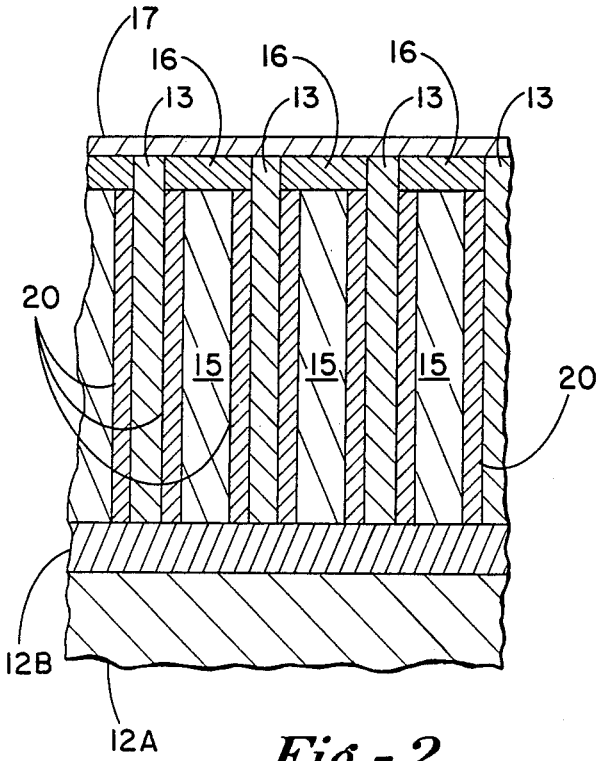
FIG. 2 is an enlarged sectioned fragmentary view showing details of the construction of the cylinder of one embodiment of the invention.
Figure 3:
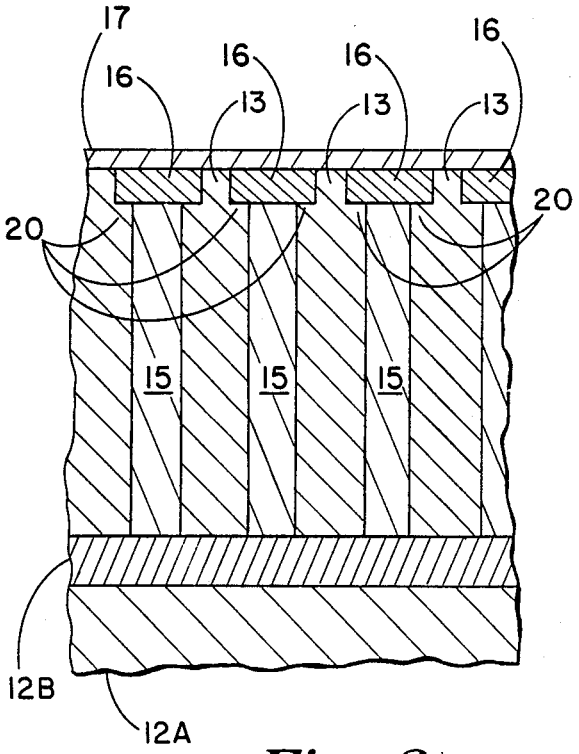
FIG. 3 is a view similar to FIG. 2 showing another embodiment.

As illustrated in FIG. 3, supports 20 can be made as part of the pole pieces 13 in the form of ledges on the pole pieces 13 that the covering layer 16 rests upon. As illustrated in FIG. 2, a pair of support members 20 may be provided for each magnet 15 or, a single support member 20 running alongside each magnet 15 may be used. It is important that supports 20 be as close as possible alongside magnets 15 and pole pieces 13 to minimize any air gap in the magnet flux path. When the support is provided by the ledge on the pole piece (FIG.

3) the potential air gap introduced by the support is avoided.

I claim:

1. In a magnetic cylinder having a rigid core, annular axially spaced-apart pole pieces extending radially outward from said core, pliable annular magnets in the spaces between the pole pieces and a non-magnetic annular covering layer over the magnets, the improvement comprising:

rigid support means having a magnetic permeability at least as great as the pole pieces extending from the core for providing radial support for said covering layer.

2. The invention as in claim 1 wherein said support means is of the same material as the pole pieces.

3. The invention as in claim 1 wherein said support means is in juxtaposition with each magnet between the magnet and an adjacent pole piece.

4. The invention as in claim 1 wherein said support means comprises a part of the pole pieces.

5. The invention as in claim 1 wherein said support means comprises an axially extending ledge on each pole piece, the covering layer resting on said ledge.

6. The invention as in claim 1 wherein said support means is annular.

7. The invention as in claim 6 wherein said support means extends between each magnet and its adjacent pole pieces.

8. For a magnetic cylinder comprising a central core, radially extending annular pole pieces which are spaced apart along the cylinder axis, radially extending annular magnets made of a relatively pliable material located in the spaces between the pole pieces and a protective layer covering the outer circumferential surface of each of the magnets, said magnetic cylinder circumferentially magnetically grasping a printing plate or the like, said plate exerting a radially inward force on the cylinder when printing, the improvement comprising:

rigid support means having a magnetic permeability at least as great as the pole pieces extending radially outward from the central core of the magnetic cylinder in juxtaposition with each annular magnet for supporting the covering layer against the radial force of the printing plate.

9. The invention as in claim 8 wherein said support means comprises an axially extending ledge on each pole piece, the covering layer resting on said ledge.

* * * * *